US010294056B2

(12) United States Patent
Jena

(10) Patent No.: US 10,294,056 B2
(45) Date of Patent: May 21, 2019

(54) WEB GUIDING DEVICE AND DEVICE FOR PROCESSING A WEB OF MATERIAL

(71) Applicant: LEONHARD KURZ Stiftung & Co. KG, Furth (DE)

(72) Inventor: Hans-Peter Jena, Nuremberg (DE)

(73) Assignee: LEONHARD KURZ STIFTUNG & CO. KG, Furth (DE)

( * ) Notice: Subject to any disclaimer, the term of this patent is extended or adjusted under 35 U.S.C. 154(b) by 97 days.

(21) Appl. No.: 15/500,715

(22) PCT Filed: Jul. 23, 2015

(86) PCT No.: PCT/EP2015/066941
§ 371 (c)(1),
(2) Date: Jan. 31, 2017

(87) PCT Pub. No.: WO2016/020206
PCT Pub. Date: Feb. 11, 2016

(65) Prior Publication Data

US 2017/0217711 A1 Aug. 3, 2017

(30) Foreign Application Priority Data

Aug. 7, 2014 (DE) ..... 10 2014 111 312

(51) Int. Cl.

| | |
|---|---|
| ***B65H 23/16*** | (2006.01) |
| ***B65H 23/038*** | (2006.01) |
| ***B41F 21/00*** | (2006.01) |
| ***B65H 23/26*** | (2006.01) |

(52) U.S. Cl.
CPC ..... *B65H 23/16* (2013.01); *B41F 21/00* (2013.01); *B65H 23/038* (2013.01); *B65H 23/26* (2013.01)

(58) Field of Classification Search
CPC ..... B65H 23/16; B65H 23/10; B65H 23/26; B65H 2404/152; B65H 2404/1521; B65H 2404/1526
See application file for complete search history.

(56) References Cited

U.S. PATENT DOCUMENTS 2,592,090 A * 4/1952 Weaver ..... B65H 23/26 242/548
5,911,386 A * 6/1999 Martin ..... B65H 23/02 242/471

FOREIGN PATENT DOCUMENTS

| | | |
|---|---|---|
| DE | 1279032 | 10/1968 |
| DE | 2754180 | 6/1979 |
| DE | 202013003546 | 8/2013 |
| GB | 873431 | 7/1961 |

* cited by examiner

*Primary Examiner* — Michael C McCullough
(74) *Attorney, Agent, or Firm* — Hoffmann & Baron, LLP

(57) ABSTRACT

The invention relates to a web guiding device (3) for guiding a material web (2), in particular a film web, with a first and a second frame element (31, 32), which
- are pivotably mounted on a first spindle (33) in respective first end areas (311, 321),
- are connected via a rotatably mounted web guide roller (34) in respective second end areas (321, 322) and
- are connected via a second spindle (35) which is connected to the first spindle (33) by means of a fixing element (37).

16 Claims, 4 Drawing Sheets

WEB GUIDING DEVICE AND DEVICE FOR PROCESSING A WEB OF MATERIAL

This application claims priority based on an International Application filed under the Patent Cooperation Treaty, PCT/EP2015/066941, filed on Jul. 23, 2015, and German Application No. DE 102014111312.8, filed on Aug. 7, 2014.

BACKGROUND OF THE INVENTION

The invention relates to a web guiding device for guiding a material web, in particular a film web, and a device for processing a material web, in particular a film web.

During the processing of material webs, such as for example film webs or paper webs, in an embossing device, printing devices or the like, the material webs are as a rule provided on reels, unwound for processing, guided to the processing position via deflection rollers and sometimes then wound up again.

If, when a new reel is provided, the material web is drawn in obliquely or asymmetrically, different tensile forces act on opposite edge areas of the material web, which can lead to creasing, folding or tearing of the material web.

However, in some cases, an asymmetrical, i.e. oblique drawing-in of a material web can also be desirable, for example in order to guarantee that an edge area of the material web is under high material tension—and therefore smooth—in order in particular to make possible a reliable reading of register marks or the like.

Irrespective of whether an asymmetrical drawing-in of the material web takes place in a targeted or undesired manner, it is necessary to correct such an asymmetry again as early as possible in order to avoid the above-named defects.

It is known to use web guide rollers with integrated differential gear to compensate for an oblique drawing-in. A detection of an oblique drawing-in and an active correction of the web guidance by active adjusting means, for example pneumatic, hydraulic or electric adjusting cylinders or the like, are also known. Such devices are however complex, expensive to buy and susceptible to faults.

Furthermore, to compensate for symmetrical web tensions, as can also occur when the web is drawn in straight, for example because of an out-of-roundness of the reel, so-called dancer rollers are known. Under varying tensile stress of the web, these swing perpendicular to the direction of extension thereof and thus again compensate for the tensile stress. However, they are not suitable for compensating for an oblique drawing-in.

SUMMARY OF THE INVENTION

An object of the present invention is therefore to provide a web guiding device and a device for processing a material web, whereby an oblique drawing-in of a material web can be corrected simply, cost-effectively and reliably.

This object is achieved by a web guiding device with the features of claim 1 and by a device for processing a material web with the features of claim 13.

Such a web guiding device for guiding a material web, in particular a film web, comprises a first and a second frame element, which:

- are pivotably mounted on a first spindle in respective first end areas,
- are connected via a rotatably mounted web guide roller in respective second end areas and
- are connected via a second spindle which is connected to the first spindle by means of a fixing element.

In comparison with a conventional dancer roller which is designed only to compensate for symmetrical web tensions of the material web, i.e. for material webs running in non-obliquely or unsymmetrically, a point of application is created by the second spindle and the fixing element, for forces acting asymmetrically, as can arise when a material web is drawn in obliquely. By spindles is meant components which can support a rotational movement of other components. Spindles can be round in cross-section, or also formed differently, wherein the cross-section profile can also vary over the longitudinal extent of a spindle.

If a stronger tensile force acts on the side of the web guide roller facing one side edge of the material web than on the opposite side, this results in a torque about the fixing element. This leads to a twisting of the frame formed by the spindles, the frame elements and the web guide roller, about the fixing element. The web guide roller is hereby deflected into the direction of the stronger tensile force. The side of the material web subjected to stronger tensile stress is thus relieved and the asymmetry produced by the oblique drawing-in is compensated for.

The material web thus leaves the web guide roller straight and with compensated tensile stress. For this, no external control, i.e. no external sensor and/or controlling element is necessary, but the forces required for correction of the web run are made available solely by the tensile stress of the material web.

The desired twisting of the web guiding device can already be achieved if the frame elements and/or the second spindle are designed flexible. The necessary flexibility can result through a suitable choice of material and by adjustment of the material strength depending on tensile forces occurring in a specific processing machine.

For example, the frame elements and/or the second spindle for these can be formed from one or more elastomeric materials in one piece or several parts. It is also possible to form only a part of the frame elements and/or of the second spindle from an elastomeric material, which part then provides the necessary flexibility. For example, only the connection points between the frame elements and the second spindle and/or the connection points between the frame elements and the web guide roller may be formed from an elastomeric or partially elastomeric bearing element. It is likewise possible that only the second spindle is formed from an elastomeric and thus intrinsically twistable material and/or the second spindle is formed from twisted or stranded partial elements made of elastomeric and/or non-elastomeric materials. The elasticity of the elastomeric material and/or the proportion of the elastomeric materials in the overall construction of the second spindle determines the overall twistability thereof and thus allows the setting of the flexibility of the web guiding device according to the invention.

Alternatively however, it is expedient if the web guide roller and/or the second spindle are attached to the frame elements by means of pivoting bearings.

Such pivoting bearings allow a pivoting of the web guide roller or the second spindle about the respective bearing point and thus make possible the twisting of the device without unnecessary material stresses being introduced into it. This increases the life of such a device.

Furthermore, the pivoting bearings are preferably formed as pivoting ball bearings. Thus all the necessary degrees of freedom are provided with a simple and stable structure of the bearings.

It is further advantageous if the second spindle is arranged between the first spindle and the web guide roller. Through the arrangement of the second spindle between the other two transverse elements of the device, the desired point of force application is created in cooperation with the fixing element.

It is particularly expedient if a ratio between the distance from the second spindle to the first spindle and the distance from the second spindle to the web guide roller is from 1:3 to 1:10, preferably 1:4 to 1:7, particularly preferably from 1:5 to 1:6.

The second spindle is preferably arranged closer to the first spindle than to the web guide roller.

It is further advantageous if the fixing element is arranged movable in axial direction on the first spindle. The tensile force compensation described above occurs symmetrically in particular with central positioning of the fixing element with respect to the first and the second spindle. If the fixing element is displaced from the central position, if desired a defined asymmetry of the tensile forces on the opposite sides of the film web can be set, as in this case different lever strokes between the opposite sides of the web guide roller and the fixing element are present.

It is expedient if the fixing element can be fixed to the first spindle by means of a fastening element, such that a desired setting of the fixing element can be ensured.

In an operational position of the web guiding device, the fixing element is preferably fixed centrally to the first spindle between the first and the second frame element. In this way it is possible to bring about the complete compensation for asymmetrical tensile forces described at the beginning, such that the material web leaves the web guide roller free of transverse stresses. By a central position is meant that the distances between the fixing element and the frame elements differ by no more than 20%, preferably by no more than 10%.

Furthermore, the fixing element is preferably mounted floating on the second spindle. This also facilitates the desired twisting of the device without the materials thereof being subjected to excessive stress.

It is in particular expedient if the fixing element is mounted on the second spindle by means of a bearing bushing. In this way a certain sliding of the fixing element is made possible without resulting in canting or the like.

An inner diameter of the bearing bushing is 5% to 20%, preferably from 10% to 12% larger than an outer diameter of the second spindle. The room for manoeuvre of the bearing bushing and thus the ease of twisting of the device can thus be set.

It is further expedient if a sliding resistance can be set between the fixing element and the second spindle by means of a further fastening element. It is thereby possible to influence how rapidly the twisting of the device follows a changed force distribution on the web guide roller, such that vibrations or oscillations of the device occurring can optionally be attenuated or even completely avoided.

In the case of a device for processing a material web by means of a web guiding device of the type described, it is expedient if the first spindle of the web guiding device is firmly fixed to the frame of the device. This makes possible the desired relative movement of the web guide roller with respect to the material web in the case of a twisting of the web guiding device because of asymmetrical tensile forces.

Furthermore, it is advantageous if the web guiding device is arranged such that, in an idle state and/or in the case of symmetrical application of force to the web guide roller, the web guide roller of the web guiding device is arranged perpendicular to a conveying direction of the material web and in the conveying plane of the material web. Thus, in this state no undesired forces are introduced into the material web by the web guiding device.

The device is preferably formed as an embossing device, in particular a hot embossing device, and/or as a printing device. The principles described are, however, applicable to all types of devices with which material webs are processed.

The invention is now explained in more detail with reference to embodiment examples. There are shown in

DETAILED DESCRIPTION OF THE INVENTION

Figure 1:
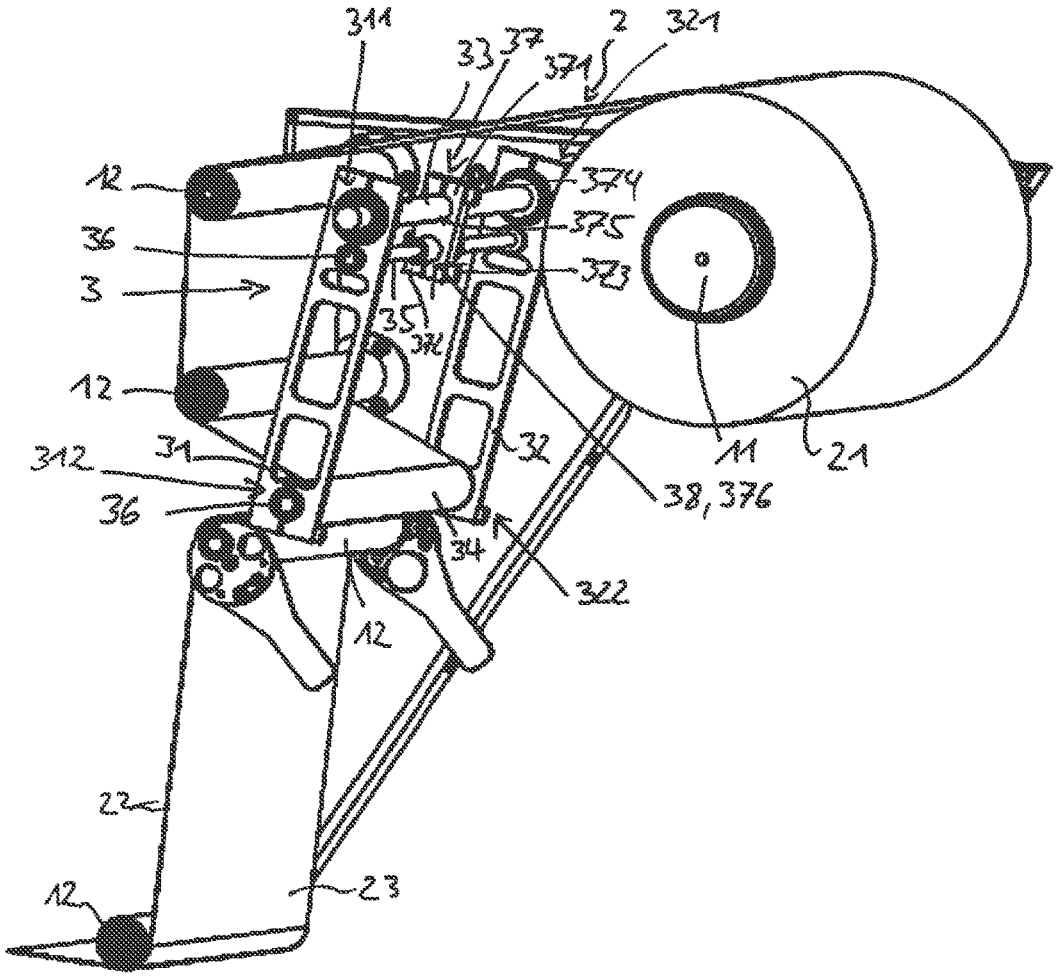
FIG. 1 A perspective view of an unwinding device for a material web with an embodiment example of a web guiding device for compensating for an oblique drawing-in of the web.
Figure 2:
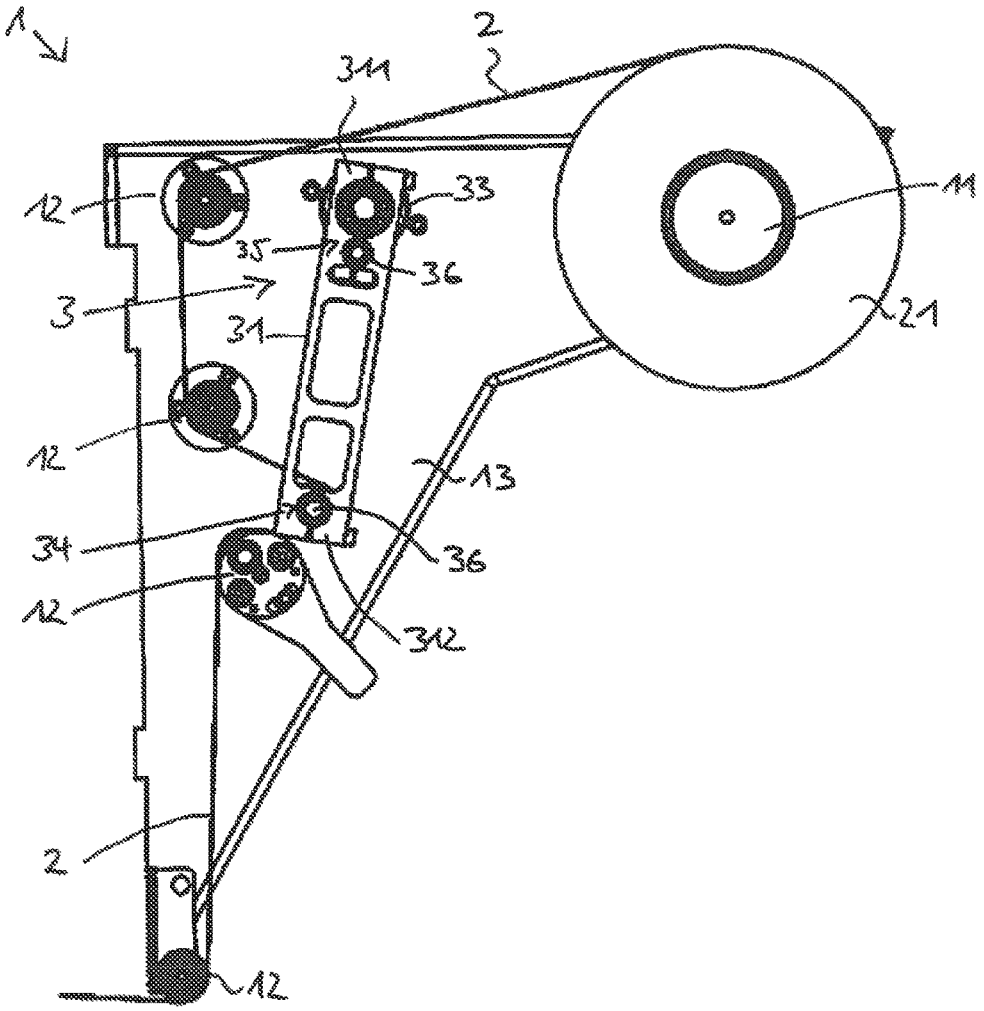
FIG. 2 A side view of the unwinding device according to FIG. 1.
Figure 3:
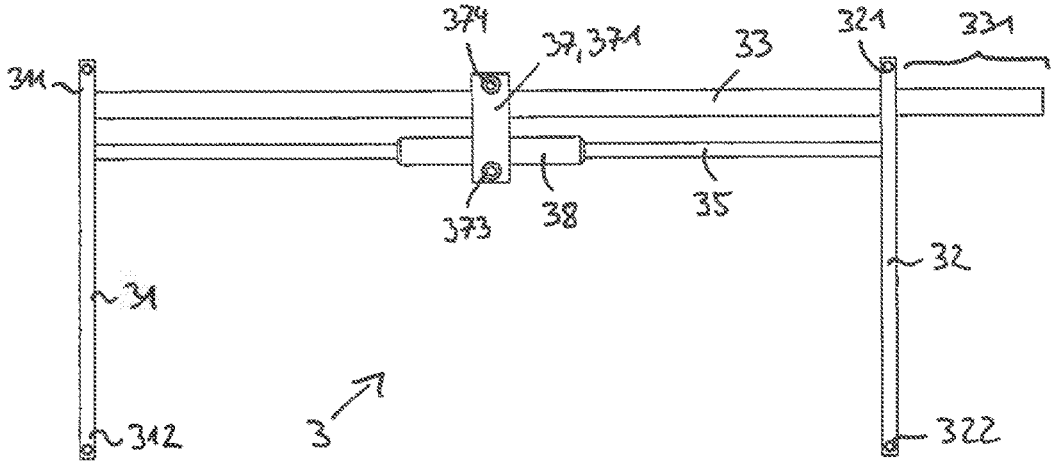
FIG. 3 A front view of the web guiding device of the unwinding device according to FIG. 1.

FIGS. 1 and 2 show the part of a device 1 for processing a material web 2, responsible for the web provision. The material web 2 is provided on a reel 21 which is held on a roller 11 of the device 1. Via a plurality of deflection rollers 12 which are arranged fixed firmly and rotatably to a frame 13 of the device 1, the unwound material web 2 is guided to the processing section. The actual processing device, for example a printing or embossing station, is not shown in the figures.

If, when a new reel 21 is inserted, the material web is introduced obliquely, when the material web 2 is drawn in this results in different tensile forces on the opposite sides 22, 23 thereof. This can lead to tears in the web, which make it necessary to stop the device 1.

In order to prevent this, the device 1 comprises a web guiding device 3. This comprises two frame elements 31, 32, which are pivotably mounted on a first spindle 33 with their respective end areas 311, 321. The spindle 33 is fixed with one end area 331 to the frame 13 of the device 1 and is not itself rotatable.

At the opposite end areas 312, 322, the frame elements 31, 32 are connected to each other via a web guide roller 34, over which the material web 2 is guided during operation of the device 1.

A further spindle 35 also connects the frame elements 31, 32 and runs parallel to the spindle 33 and to the web guide roller 34. Both the spindle 35 and the web guide roller 34 are linked to the frame elements 31, 32 with pivoting ball bearings 36. The spindle 35 and the web guide roller 34 can thus not only rotate about their respective extension spindles but are also tiltable with respect to the frame elements 31, 32.

The spindle 35 is, in addition, connected to the spindle 33 by means of a fixing element 37. The fixing element 37 consists of two halves 371, 372, which can be fixed against each other by means of screws 373 and 374 and which have respective holders 375, 376 for the spindles 33, 35. The spindle 35 is held with a sliding bushing 38 in the fixing element 37, the inner diameter of which is preferably 5% to 20%, particularly preferably 10% to 12% greater than the outer diameter of the spindle 35.

Depending on the clearance of the holders 375, 376 and according to the tightening force of the screws 373, 374, it is thus also possible to determine how firmly the fixing element 37 is located on the spindles 33, 35.

If the screws 373, 374 are loosened, the fixing element 37 can be moved on the spindles 33, 35. The figures show the fixing element 37 in a sideways position. During the operation of the device 1 it is expedient to position the fixing element 37 centrally on the spindles 33, 35, such that the respective distances from the fixing element to the frame elements 31, 32 are substantially equal and differ from each other preferably by no more than 20%, particularly preferably by no more than 10%. The desired symmetrical alignment of the web guide roller 34 with respect to the material web 2 is thus ensured.

If the material web 2 is inserted obliquely into the device 1, the tensile forces which act on the material web 2 are not symmetrical. The tensile force and web speed therefore differ for the two sides 22, 23 of the material web.

As soon as the material web 2 is guided over the web guide roller 34, different forces thus also act on the opposite sides of the web guide roller 34. The frame elements and the second spindle can now act as levers which transmit these forces to the fixing element 37. This results in a torque about the fixing element 37.

Figure 4:
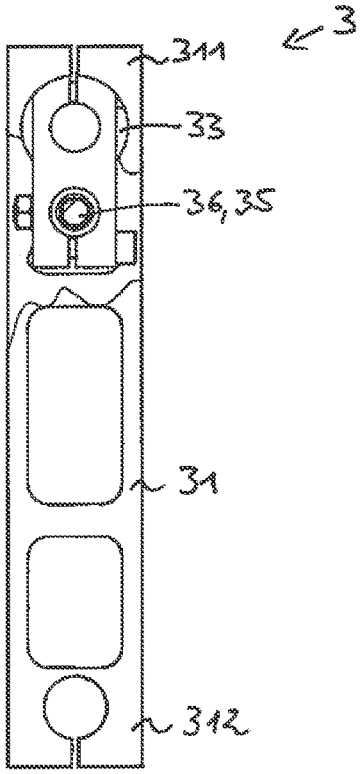
FIG. 4 A side view of the web guiding device according to FIG. 3 in the case of symmetrical drawing-in of the web.
Figure 5:
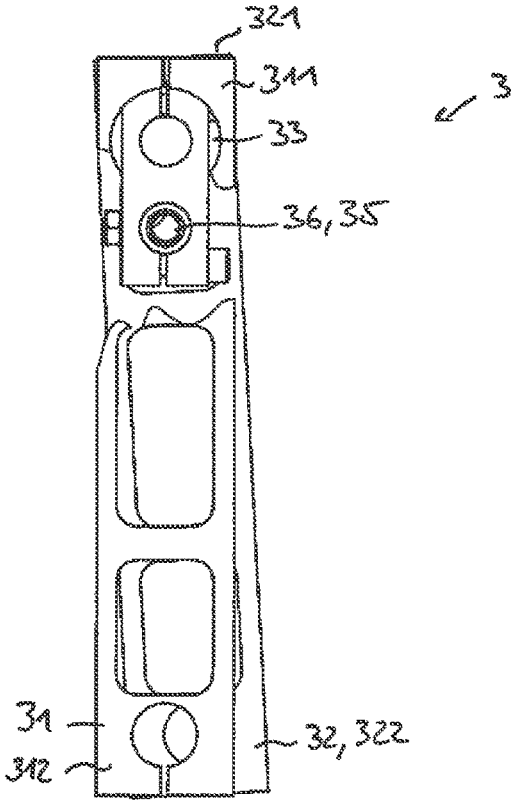
FIG. 5 A side view of the web guiding device according to FIG. 3 in the case of asymmetrical drawing-in of the web on the left side.
Figure 6:
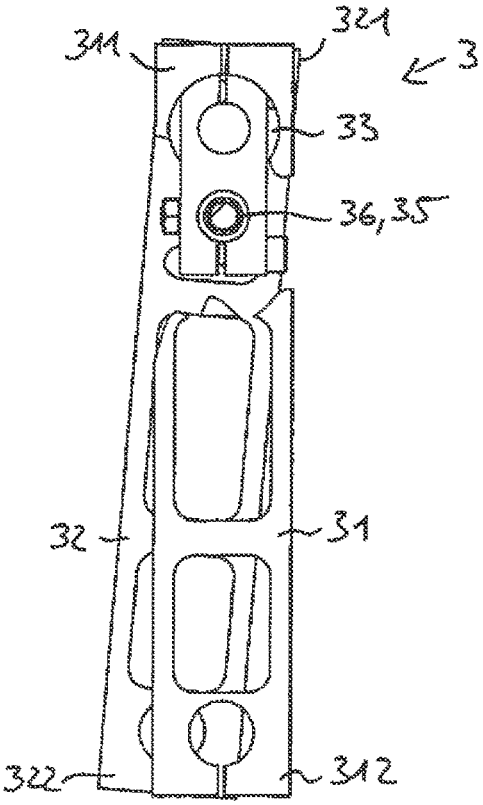
FIG. 6 A side view of the web guiding device according to FIG. 3 in the case of asymmetrical drawing-in of the web on the right side.

As the first spindle 33 is mounted firmly with the end area 331, no movement of the spindle 33 itself results thereby. As can be seen in FIGS. 5 and 6 however, the frame elements 31, 32 can pivot about the spindle 33 and be deflected relative to their equilibrium position shown in FIG. 4. The spindle 35 and the web guide roller 34 can follow this movement and, because of their mounting by means of the pivoting ball bearings 36, can thereby be tilted at an angle to the spindle 33 and thus also at an angle to the original web guidance plane.

In other words the web guide roller 34 can thus follow the asymmetrical forces caused by a material web 3 inserted obliquely. The web guide roller 34 is further deflected until the forces acting on its end areas are again equal, i.e. no more torque is transmitted to the fixing element 37. The more rapidly running side edge of the material web 2 is hereby braked and the slower running side edge of the material web 2 accelerated. The oblique drawing-in of the material web 2 is thus corrected and the material web 2 runs evenly through the device 1. In the course of this correction the web guide roller 34 again returns to the neutral position shown in FIG. 4 and remains therein, so long as the material web 2 continues to run straight.

Overall, a simple correction of an oblique drawing-in of the web can thus be achieved, which requires no active adjusting or sensor devices. The device is thus particularly cost-effective and fail-safe.

LIST OF REFERENCE NUMBERS

1 Device
11 Roller
12 Deflection roller
13 Frame
2 Material web
21 Reel
22 Side edge
23 Side edge
3 Web guiding device
31 Frame element
311 End area
312 End area
32 Frame element
321 End area
322 End area
33 First spindle
331 End area
34 Web guide roller
35 Second spindle
36 Pivoting ball bearing
37 Fixing element
371 Half
372 Half
373 Screw
374 Screw
375 Holder
376 Holder
38 Bushing

The invention claimed is:

1. A web guiding device for guiding a film web, the web guiding device comprising:
- a first spindle;
- a first and a second frame element, which are pivotably mounted on the first spindle in respective first end areas;
- a rotatably mounted web guide roller connected between the first and the second frame elements in respective second end areas;
- a second spindle connected between the first and second frame elements; and
- a fixing element connected between the first spindle and the second spindle, wherein the fixing element is mounted floating on the second spindle.

2. The web guiding device according to claim 1, wherein the web guide roller and/or the second spindle are attached to the frame elements by means of pivoting bearings.

3. The web guiding device according to claim 2, wherein the pivoting bearings are formed as pivoting ball bearings.

4. The web guiding device according to claim 1, wherein the second spindle is arranged between the first spindle and the web guide roller.

5. The web guiding device according to claim 1, wherein the fixing element is mounted on the second spindle by means of a bearing bushing.

6. The web guiding device according to claim 5, wherein an inner diameter of the bearing bushing is 5% to 20% larger than an outer diameter of the second spindle.

7. The web guiding device according to claim 1, wherein a sliding resistance can be set between the fixing element and the second spindle by means of a further fastening element.

8. A device for processing a film web, with a web guiding device according to claim 1.

9. The device according to claim 8, wherein the first spindle of the web guiding device is firmly fixed to the frame of the device.

10. The device according to claim 8, wherein the web guiding device is arranged such that, in an idle state and/or in the case of symmetrical application of force to the web guide roller, the web guide roller of the web guiding device is arranged perpendicular to a conveying direction of the material web and in the conveying plane of the material web.

11. The device according to claim 8, wherein the device is formed as a hot embossing device, and/or as a printing device.

12. A web guiding device for guiding a film web, the web guiding device comprising:

a first spindle;

a first and a second frame element, which are pivotably mounted on the first spindle in respective first end areas;

a rotatably mounted web guide roller connected between the first and the second frame elements in respective second end areas;

a second spindle connected between the first and second frame elements; and a fixing element connected between the first spindle and the second spindle, wherein the second spindle is arranged between the first spindle and the web guide roller, and wherein a ratio between the distance from the second spindle to the first spindle and the distance from the second spindle to the web guide roller is from 1:3 to 1:10.

13. The web guiding device according to claim 12, wherein the fixing element is arranged movable in an axial direction on the first spindle.

14. The web guiding device according to claim 12, wherein the fixing element is mounted floating on the second spindle.

15. A web guiding device for guiding a film web, the web guiding device comprising:

a first spindle;

a first and a second frame element, which are pivotably mounted on the first spindle in respective first end areas;

a rotatably mounted web guide roller connected between the first and the second frame elements in respective second end areas;

a second spindle connected between the first and second frame elements; and a fixing element connected between the first spindle and the second spindle, wherein the fixing element is arranged movable in an axial direction on the first spindle, and wherein the fixing element can be fixed to the first spindle by means of a fastening element.

16. The web guiding device according to claim 15, wherein, in an operational position of the web guiding device, the fixing element is fixed centrally to the first spindle between the first and the second frame element.

* * * * *